US008847786B2

(12) United States Patent
Bandou et al.

(10) Patent No.: US 8,847,786 B2
(45) Date of Patent: Sep. 30, 2014

(54) DRIVING SCENE TRANSITION PREDICTION DEVICE AND RECOMMENDED DRIVING OPERATION DISPLAY DEVICE FOR MOTOR VEHICLE

(75) Inventors: Takashi Bandou, Nagoya (JP); Takayuki Miyahara, Kariya (JP); Yukimasa Tamatsu, Okazaki (JP)

(73) Assignee: Denso Corporation, Kariya (JP)

( * ) Notice: Subject to any disclaimer, the term of this patent is extended or adjusted under 35 U.S.C. 154(b) by 302 days.

(21) Appl. No.: 13/325,402

(22) Filed: Dec. 14, 2011

(65) Prior Publication Data

US 2012/0154175 A1 Jun. 21, 2012

(30) Foreign Application Priority Data

Dec. 17, 2010 (JP) ..... 2010-282000

(51) Int. Cl.
*G08B 21/00* (2006.01)
*G08G 1/16* (2006.01)

(52) U.S. Cl.
CPC ..... *G08G 1/164* (2013.01); *G08G 1/167* (2013.01); *G08G 1/166* (2013.01); *G08G 1/165* (2013.01)
USPC ..... 340/903; 340/435; 340/436; 340/901; 701/301

(58) Field of Classification Search
USPC ..... 340/435, 436, 901, 903; 701/301
See application file for complete search history.

(56) References Cited

U.S. PATENT DOCUMENTS

2003/0187578 A1 10/2003 Nishira et al.
2003/0195703 A1 * 10/2003 Ibrahim ..... 701/301
2004/0019425 A1 * 1/2004 Zorka et al. ..... 701/301
2005/0102070 A1 * 5/2005 Takahama et al. ..... 701/1

FOREIGN PATENT DOCUMENTS

JP 3714258 9/2005
WO WO2012014280 2/2012

OTHER PUBLICATIONS

Notification of Reasons for Rejection issued Nov. 29, 2012 in corresponding Japanese Application No. 2010-282000 with English translation.

* cited by examiner

*Primary Examiner* — Mohammad Ghayour
*Assistant Examiner* — Mark Rushing
(74) *Attorney, Agent, or Firm* — Harness, Dickey & Pierce, PLC

(57) ABSTRACT

A symbolizing execution section symbolizes information regarding driving scenes, and describes an entire driving scene around the location of an own motor vehicle. This makes it possible to only increase the information to be symbolized when the number of traffic participants is increased. This can adopt the increase of the traffic participants. A symbol transition prediction section predicts a transition of the symbolized driving scene by using influence which affects the operation of the traffic participants caused by the operation of the own motor vehicle. This makes it possible to increase prediction accuracy while decreasing a large amount of calculation on predicting the transition of driving scene.

10 Claims, 4 Drawing Sheets

WITH SUFFICIENT INFLUENCE

WITHOUT SUFFICIENT INFLUENCE

DRIVING SCENE TRANSITION PREDICTION DEVICE AND RECOMMENDED DRIVING OPERATION DISPLAY DEVICE FOR MOTOR VEHICLE

CROSS-REFERENCE TO RELATED APPLICATION

This application is related to and claims priority from Japanese Patent Application No. 2010-282000 filed on Dec. 17, 2010, the contents of which are hereby incorporated by reference.

BACKGROUND OF THE INVENTION

1. Field of the Invention

The present invention relates to driving scene transition prediction devices capable of predicting how a driving scene of a motor vehicle is transited to another driving scene in the future, and further relates to recommended driving operation display devices capable of supplying and displaying driving recommendation operation to the driver of the motor vehicle on the basis of the predicted driving scene.

2. Description of the Related Art

A conventional patent document 1, Japanese laid open publication No. 2003-228800, discloses a device for predicting future operation of motor vehicles which are present around an own motor vehicle. The device generates future operation of the own motor vehicle and generates recommended control input values and supplies them to the driver of the own motor vehicle on the basis of the generated future operation.

The device disclosed in the conventional patent document 1 detects information such as a location and a drive lane of each of motor vehicles around the own motor vehicle, and a speed of the own motor vehicle. The device further calculates a speed of the own motor vehicle on the drive lane, and the location and the speed on each drive lane of each of the motor vehicles around the own motor vehicle on the basis of the above detected information. A prediction means in the device predicts influence of the own motor vehicle to a group of other motor vehicles around the own motor vehicle on the basis of vehicle models, the number of the vehicle models is equal to the number of the other motor vehicle detected by the device. The vehicle model is composed of an operation model of a motor vehicle in a forward travel direction, and a model of changing a travel lane. For example, the operation model in the forward drive direction is generated every motor vehicle in order to maintain a constant travel time period between a preceding motor vehicle and the motor vehicle (as a following motor vehicle) on the basis of the preceding motor vehicle which runs in front of the motor vehicle.

In order to predict the influence of the operation of the own motor vehicle to the other motor vehicles, the operation model of the own motor vehicle inputs variable data items and the device calculates entire operation (location) of the group of the motor vehicles by using each vehicle model when a time series pattern of an optional acceleration instruction value is input.

The device disclosed by the conventional patent document 1 predicts the operation of a group of motor vehicles which travel in the same direction of the own motor vehicle only. This prediction of the operation of the motor vehicle group is predicted on the basis of a simple model in which a preceding motor vehicle and a following motor vehicle maintain a constant drive time period.

However, in actual driving scenes, there are various traffic participants such as pedestrians and coming motor vehicles which travel on an adjacent lane or an opposite lane in addition to motor vehicles which travel in the forward direction on the same lane on which the own motor vehicle drives, and they are affected to each other in an actual driving scene. Because, the operation of the own motor vehicle is affected from the state of a traffic signal on a current road, a frame problem occurs when the device disclosed in the conventional patent document 1 is applied to a more usual driving scene where various traffic participants including traffic signals have a complex operation. The frame problem is caused when an operation model such as a motor vehicle model is assigned to each of traffic participants and the entire operation of the traffic models is predicted on the basis of each of the operation models.

Further, the conventional patent document 1 assigns the operation model to each traffic participant. Such an operation model is generated by using information of other traffic participants such as preceding motor vehicles. Accordingly, when a new traffic participant comes or an existing traffic participant is removed from the driving scene, it is necessary to reset the operation model of each of the traffic participants and to predict the entire operation model of the traffic participants. The number of the traffic participants is often changed in an actual driving scene. Accordingly, the device disclosed in the conventional patent document 1 must cancel the operation model previously predicted, and must frequently predict a new operation model every changing the number of the traffic participants such as pedestrians, motor vehicles and traffic signals. During the process of predicting a new operation model, it is impossible for the device to use the previously predicted operation model of the traffic participants, and difficult to timely provide effective information to the driver of the own motor vehicle.

SUMMARY

It is therefore desired to provide a driving scene transition prediction device capable of predicting a future operation model of traffic participants such as motor vehicles, pedestrians and traffic signals with a decreased calculation amount even if the total number of the traffic participants is changed, and to provide a recommended driving operation display device capable of displaying recommended driving operation to the driver of an own motor vehicle on the basis of the predicted future operation model obtained by the driving scene transition prediction device.

To achieve the above purposes, the present exemplary embodiment provides a driving scene transition prediction device has a drive environmental information obtaining section, a traffic participant information obtaining section, a symbolizing execution section, an interaction estimation section and a prediction section as a symbol transition prediction section.

The drive environmental information obtaining section obtains information regarding a lane environment of a lane on which the own motor vehicle drives. The traffic participant information obtaining section detects traffic participants around the own motor vehicle. The symbolizing execution section symbolizes information regarding drive environment or lane environment, information regarding own motor vehicle and information regarding the traffic participants which form a driving scene (or a traffic scene) of the own motor vehicle. The symbolizing execution section describes the driving scene of the own motor vehicle by using the symbolized information. The interaction estimation section estimates interaction, as influence, between the traffic participants on the basis of a state change of each of the traffic participants containing own motor vehicle. The prediction section predicts a transition of the symbolized driving scene symbolized by the symbolizing execution section for each candidate selectable by the own motor vehicle on the basis of the influence estimated by the interaction estimation section.

In the recommended driving operation display device equipped with the driving scene transition prediction device according to the exemplary embodiment, the symbolizing execution section symbolizes the entire of driving scene around the own motor vehicle. This makes it possible to obtain robustness in recognition and prediction of the driving scene. That is, even if the number of the traffic participants such as motor vehicles other than the own motor vehicle, pedestrians and traffic signals, it is possible to increase the expression of symbols only. Therefore it is not necessary to set operation models again and not necessary to execute the prediction when the number of the traffic participants is changed. On the other hand, it is necessary to execute the prediction again in the prior art techniques. The device according to the exemplary embodiment is adequately and flexibility applied to the increase and decrease of the number of traffic participants.

In the recommended driving operation display device equipped with the driving scene transition prediction device according to the exemplary embodiment, the prediction section predicts how the symbolized driving scene is transited in the candidates of operation to be executed by the own motor vehicle. At this time, the prediction section estimates the influence of the operation of the own motor vehicle to the operation of the traffic participants. The prediction section predicts the transition of the symbolized driving scene on the basis of the estimated interaction (or influence). Accordingly, it is possible for the device according to the exemplary embodiment to decrease a large amount of calculation when compared with the prior art techniques which use operation models which consider the interaction between each traffic participant and other traffic participants. Further, because the device according to the exemplary embodiment predicts the interaction (or influence) on the basis of the actual state change of each of the traffic participants, it is possible to increase the prediction accuracy of the transition of the driving scene.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
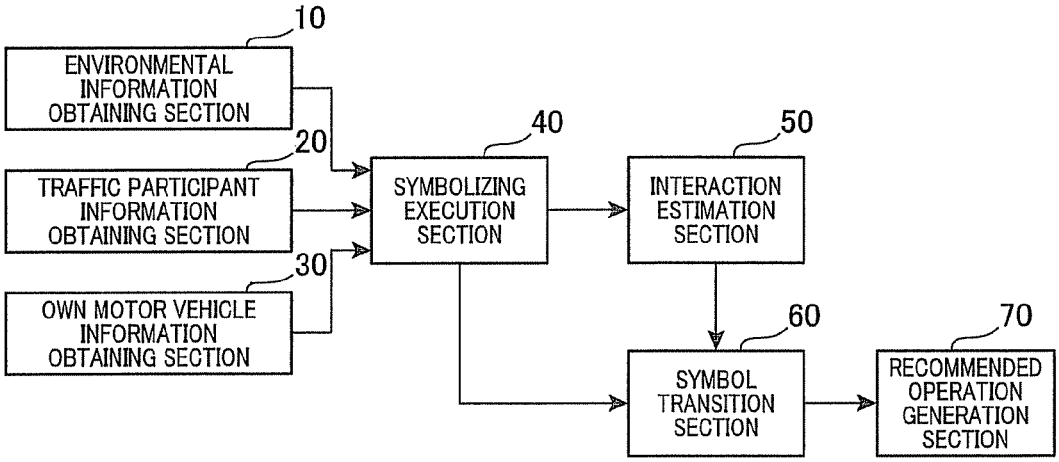
FIG. 1 is a block diagram showing an entire structure of a recommended driving operation display device equipped with a driving scene transition prediction device for a motor vehicle according to an exemplary embodiment of the present invention.

Hereinafter, various embodiments of the present invention will be described with reference to the accompanying drawings. In the following description of the various embodiments, like reference characters or numerals designate like or equivalent component parts throughout the several diagrams.

Exemplary Embodiment

A description will be given of a recommended driving operation display device equipped with a driving scene transition prediction device according to an exemplary embodiment of the present invention with reference to FIG. 1 to FIG. 9.

FIG. 1 is a block view showing an entire structure of the recommended driving operation display device equipped with the driving scene transition prediction device for a motor vehicle according to the exemplary embodiment.

The recommended driving operation display device equipped with the driving scene transition prediction device is comprised of various types of sensors, a communication device and an electric control device (hereinafter, referred to as the "ECU"). These sensors and the communication device obtain various types of vehicle information. The ECU executes processes of predicting a transition of a driving scene (or a traffic scene) of an own motor vehicle, and for generating and displaying the recommendation driving operation to the driver of the own motor vehicle on the basis of the predicted transition of the driving scene. FIG. 1 shows these processes as functional blocks to be executed by the ECU.

As shown in FIG. 1, a drive environmental information obtaining section 10 in the device obtains global environmental information such as a season, a time, a weather condition, etc., and infrastructure information around the driving road of the own motor vehicle such as a shape and a slope of a surface of the driving road, a location of a lane mark, a distance to an inter section and a shape of the intersection. The drive environmental information obtaining section 10 obtains the above global environmental information by using an in-vehicle navigation device, a radar device using a millimeter wave and a radar wave, an in-vehicle camera, and a road-to-vehicle communication device on the basis of a dedicated short range communications (DSRC).

A traffic participant information obtaining section 20 detects, as traffic participant information, a position and a driving speed of each of other motor vehicles which are existing around the own motor vehicle and a location and a speed of each of pedestrians around the own motor vehicle.

The traffic participant information obtaining section 20 further obtains driving information of the other motor vehicles such as an operational state of directional indicators or directional signals, an operational state of acoustic horns, an operational state of a brake pedal, etc. Other motor vehicles contain preceding motor vehicles which run a front of the own motor vehicle on the same lane, and coming motor vehicles which drive on the opposite lane. Further, the traffic participant information obtaining section 20 detects a location and a state of a traffic signal as one of pedestrians. The traffic participant information obtaining section 20 obtains the above traffic participant information through the in-vehicle camera, the road-to-vehicle communication device, the vehicle communication device, etc.

In the block diagram shown in FIG. 1, the drive environmental information obtaining section 10 and the traffic participant information obtaining section 20 are different sections on the basis of the obtained information. However, the actual driving scene transition prediction device, the drive environmental information obtaining section 10 and the traffic participant information obtaining section 20 use the same devices such as sensors in order to obtain the necessary information.

An own motor vehicle information obtaining section 30 obtains driver's information in addition to own motor vehicle information.

The own motor vehicle information contains a driving state and an operational state of the own motor vehicle such as a location, a speed, an acceleration speed, a steering angle, an operational state of directional indicators, an operational state of acoustic horns, an operational state of lamps such as head lamps, etc. of the own motor vehicle. The driver's information contains physiological information such as a direction and location of the driver, a direction of the driver's eyes, a driver's blood pressure, an electrical potential of the driver's heart, an electrical potential of a driver's skin, etc. The driving scene transition prediction device obtains various information regarding the driving conditions and the operation states of the own motor vehicle from various types of sensors such as a speed sensor, an acceleration sensor, and a steering angle sensor and various in-vehicle devices such as a navigation device, the directional indicators, and lamp control devices. The driving scene transition prediction device further obtains the information regarding the driver of the own motor vehicle through a driver's monitoring camera equipped with the own motor vehicle, physiological information obtaining device mounted to steering wheels, etc.

It is possible for the drive environmental information obtaining section 10 (or one of the traffic participant information obtaining section 20, or the own motor vehicle information obtaining section 30) to generate new information on the basis of the information previously described. For example, the drive environmental information obtaining section 10 can generate information such as a dead position of the driver of the own motor vehicle and a ratio of a dead area (or a dead ground), which is an invisible area to the driver of the own motor vehicle, to an entire visual area of the driver of the own motor vehicle on the basis of the location of the own motor vehicle and the location of pedestrians and buildings around the own motor vehicle. Further, it is possible for the drive environmental information obtaining section 10 to calculate information such as an apparent visibility to the driver of the own motor vehicle to see an object on the basis of a color and a shape of pedestrians and buildings around the own motor vehicle, and to calculate a visibility of the object on the basis of a weather such as fog and rain and an intensity of illumination of the area around the own motor vehicle. Still further, it is possible for the drive environmental information obtaining section 10 to calculate a current depth of sleep if the driver on the basis of physiological information of the driver of the own motor vehicle.

When a sensor-rich device obtains the above information, it is possible to improve the accuracy of predicting an operation of traffic participants around the own motor vehicle. However it is not necessary to use all of the above information. That is, it is possible to use some of the above information according to a purpose and a degree of accuracy of predicting such traffic participants. On other hand, it is possible to use other information in addition to the above information.

Figure 2:
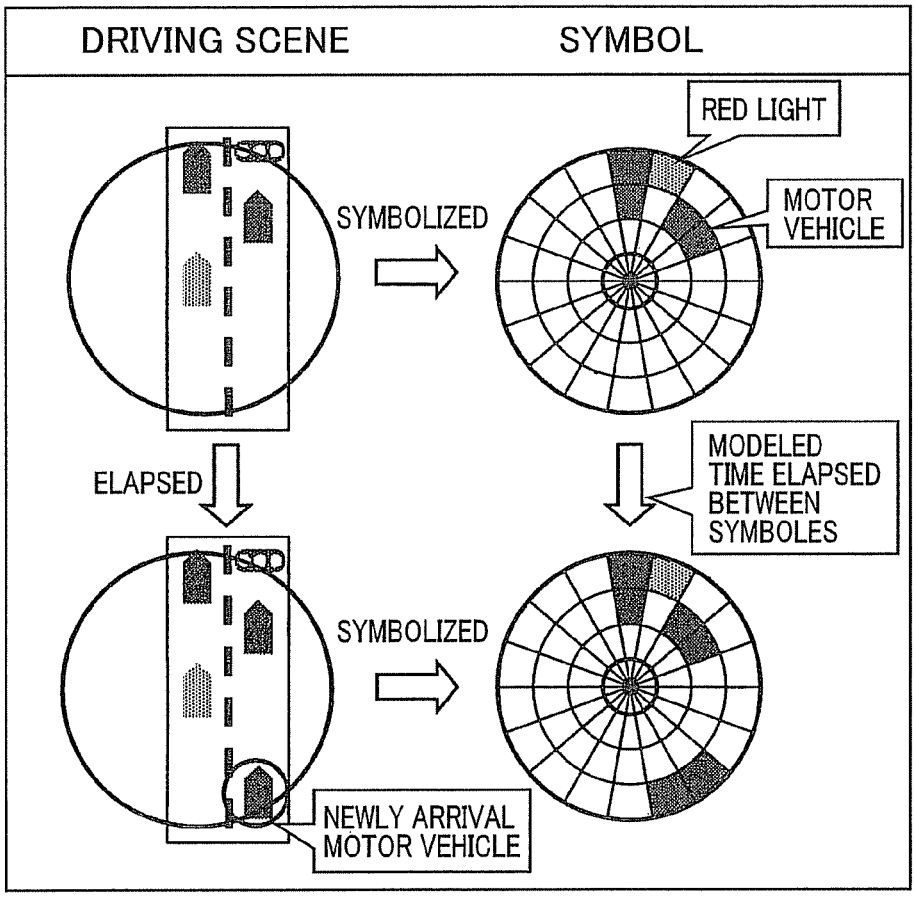
FIG. 2 is a view showing a process of symbolizing various information executed by a symbolizing execution section in the recommended driving operation display device according to the exemplary embodiment shown in FIG. 1.

A symbolizing execution section 40 symbolizes various information obtained by each of the drive environmental information obtaining section 10, the traffic participant information obtaining section 20 and the own motor vehicle information obtaining section 30. As shown in FIG. 2, the symbolizing execution section 40 generates an entire driving scene of the own motor vehicle on the basis of the symbolized information.

The most simple way to symbolize information is quantization. FIG. 2 is a view showing a process of symbolizing various information items executed by the symbolizing execution section 40 in the recommended driving operation display device according to the exemplary embodiment shown in FIG. 1.

As shown in FIG. 2, the symbolizing execution section 40 determines virtual grids around the own motor vehicle, and assigns the virtual grids to traffic participants such as pedestrians, traffic signals, and motor vehicles around the own motor vehicle. This process determines the location of each of the traffic participants. A type of each of the traffic participants can be recognized with a label.

Further, the symbolizing execution section 40 symbolizes the information by using symbol vectors. Each symbol vector is composed of predetermined elements corresponding information to be symbolized. For example, clear weather, rain and cloud are designated by using a combination of 1 and 0. Time is classified to several time-bands (such as early morning, daytime and night) and a combination of 1 and 0 is assigned to these time-bands. Still further, it is possible to distinguish the driving operations to each other by using a combination of 1 and 0. For example, there are the driving operations such as directional indicators, acoustic horns, and the brake pedal.

It is possible to easily symbolize information such as environmental information, own motor vehicle information and traffic participant information by using symbol vectors. Further, it is possible to adapt the change of the number of information by changing the number of dimensions of symbol vectors. It is necessary to make a one-to-one correspondence between traffic participants and location of grids or labels in order to avoid any confusion of the traffic participants to each other.

The above symbolizing process can remove detailed data, but express the entire driving scene of the own motor vehicle with a simple structure. This makes it possible to obtain robustness in recognition and prediction of such driving scene. For example, as shown in FIG. 2, even if the number of traffic participants is increased or decreased, it is sufficient to change the expression of the symbol without re-prediction of the driving scene. This makes it possible to flexibly handle the change of the number of traffic participants.

In addition, the above symbolization of information can be performed by using other methods other than the quantization previously described. For example, it is possible to execute the symbolizing process by using Eigenspace method or clustering method. Eigenspace method is a well-known method to express information by using eigenvector as a base of a partial space of an eigenvector of a variance covariance matrix of a set when the entire of information is the set. On the other hand, the clustering method classifies a plurality of data items. It is possible to symbolize the information with high efficiency by using the above methods.

For example, when the above clustering method is applied to grids around the own motor vehicle, traffic participants out of a road are designated by using rough grids, and traffic participants within the area of the road are designated by fine grids. It is possible to express high priority information with high resolution, and to express low priority information with low resolution. It is possible to adopt the above clustering method to information to be classified without considering the type of information.

The information of the driving scene symbolized by the symbolizing execution section 40 is transferred to an interaction estimation section 50 and a symbol transition prediction section 60 (or a prediction section 60). The interaction estimation section 50 estimates interaction (will be referred to as the "influence") between traffic participants such as the own motor vehicle, other motor vehicles, pedestrians and traffic signals on the basis of the change of operation of a motor vehicle such as the change of a distance between motor vehicles, a change of a speed or a relative speed between the motor vehicles, a reaction of other motor vehicles around the own motor vehicle to acoustic horn and directional indicators of the own motor vehicle, information transferred between the motor vehicles and information between a road and the own motor vehicle. It is possible to contain information regarding operation of other traffic participants.

A description will now be given of an exemplary method of estimating the above influence between traffic participants (grids) such as motor vehicles, pedestrians and traffic signals.

Figure 3:
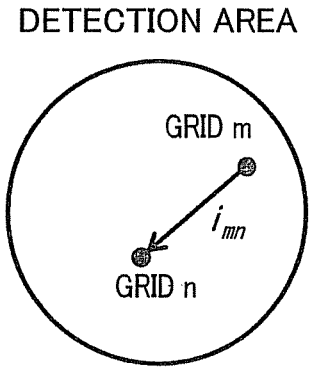
FIG. 3 is a view visually showing influence between traffic participants (grids)

FIG. 3 is a view which visually shows influence between traffic participants (grids). As shown in FIG. 3, although FIG. 3 shows one vector from the grid m to the grid n, vectors corresponding to influence from the m-th grid in a detection area to each of grids are expressed by using $i_{m(vec)}=(i_{m1}, \ldots, i_{mNg})^T$, where Ng is the number of grids.

Further, a group of the vectors ($i_{m(vec)}$, m=1, . . . , Ng) is expressed by $I=(i_{1(vec)}, \ldots, \text{and } i_{Ng(vec)})$. This group of the vectors $I=(i_{1(vec)}, \ldots, \text{and } i_{Ng(vec)})$ will be referred to as the "influence matrix".

The change of a grid state observed at the m-th grid in the detection area is expressed by $r_{m(vec)}=(r_{m1}, \ldots, r_{mNr})^T$, where Nr is the number of dimensions of the predetermined state as the change of the grid state to be observed. (For example, when the grid is occupied by a motor vehicle only, without including any pedestrian and traffic signal, a change of the grid state corresponds to a mode change such as acceleration and deceleration of the motor vehicle and a state of following a preceding motor vehicle, a display state or a non-display state of directional indicators, and a state of turning on and off acoustic horn. Similar to the influence matrix as previously described, a group of state change of each grid is expressed by $R=(r_{1(vec)}, \ldots, r_{Ng(vec)})$. This group will be referred to as the "observation matrix".

It is possible to obtain a posterior probability of the influence matrix I at time "t" by considering the state change of each grid expressed by the observation matrix R. On considering Markov property of a conditional independency of a time transition of influence in the observation matrix R and a time transition of influence, the posterior probability of influence can be expressed by the following equation (1). In the following equations, vectors will be expressed by bold-faced characters.

$$p(I_t|R_{1:t}) \propto p(R_t|I_t)p(I_t|R_{1:t-1}) \quad (1).$$

The posterior probability of influence at each grid can be expressed by the following equation (2) which is obtained from the above equation (1).

$$p(i_{m,t}|R_{1:t}) \propto p(R_t|i_{m,t})p(i_{m,t}|R_{1:t-1}) \quad (2).$$

Likelyhood ratio $p(R_t|i_{m(vec),t})$ as influence at the m-th grid can be expressed by the following equation (3) when observation matrix R is independently from the grid and each dimension of the observation matrix R.

$$\begin{aligned} p(R_t \mid i_{m,t}) &= \prod_{k=1}^{Ng} p(r_{k,t}, r_{m,t} \mid i_{mk,t}) \\ &= \prod_{k=1}^{Ng} \prod_{l=1}^{Nr} p(r_{kl,t}, r_{ml,t} \mid i_{mk,t}). \end{aligned} \quad (3)$$

At this time, the likelyhood ratio $p(r_{k1,t}, r_{m1,t}|i_{mk,t})$ can be expressed by the following equation (4) while Bernoulli's process conditioned by influence is considered.

$$\begin{aligned} p(r_{kl,t}, r_{ml,t} \mid i_{mk,t}) &= Bern(r_{kl,t}, r_{ml,t} \mid \mu(i_{mk,t})) \\ &= \mu_i^{r_{kl,t}r_{ml,t}}(1-\mu_i)^{1-r_{kl,t}r_{ml,t}}. \end{aligned} \quad (4)$$

As can be expressed by the following equation (5), the parameter $\mu_i$ is a conditional parameter according to the presence and absence of influence. It is acceptable to calculate this parameter $\mu_i$ on the basis of an experimental actual value or an estimated value obtained by Bayesian inference.

$$\mu_i = \begin{cases} \mu_0 & (i_{mk,t}=0) \\ \mu_1 & (i_{mk,t}=1). \end{cases} \quad (5)$$

The prior probability $p(i_{m(vec),t}|R_{1:t-1})$ at each grid in the equation (2) can be obtained by the following process.

There is a spatial element in dynamics of influence which is caused by a relative location between the traffic participants according to the time elapse from time "t−1" to time "t". On considering such a spatial element in dynamics of influence, it is at first considered to change a location of each grid according to the time elapse.

Figure 4:
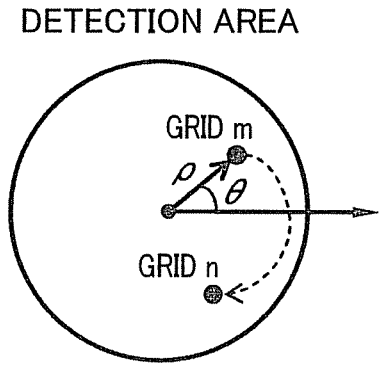
FIG. 4 is a view showing a process of predicting a transition of a grid caused by influence in order to predict the influence between the traffic participants.

FIG. 4 is a view showing a process of predicting a transition of a grid to which influence affects in order to predict influence between the traffic participants. The location of each grid is expressed by using a polar coordinates system shown in FIG. 4.

The grid location in the polar coordinates system can be expressed by $g^{(p)}=(\rho, \theta)^T$, and a grid index is expressed by $g^{(i)}$.

The probability to change the location of a grid from m at time "t−1" to n at time "t" can be expressed by the following equation (6) by considering Gaussian process. In the following equation (6), $\tau g$ indicates variance covariance matrix.

$$p(g_t^{(i)} = n \mid g_{t-1}^{(i)} = m) = \frac{1}{2\pi|\sum_g|^{1/2}} \exp\left(-\frac{1}{2}\left(g_{n,t}^{(p)} - \hat{g}_{m,t}^{(p)}\right)^T \sum_g^{-1} \left(g_{n,t}^{(p)} - \hat{g}_{m,t}^{(p)}\right)\right). \quad (6)$$

The hut $g^{(p)}_{m,t}$ in the equation (6) indicates a predicted location of a grid at time "t" which can be expressed by the following equation (7) by using a relative speed $v_{m,\,t-1}$ (polar coordinates system) of each observed grid.

$$\hat{g}_{m,t}^{(p)} = g_{m,t-1}^{(p)} + v_{m,t-1} \quad (7).$$

By using the above grid transition model, the probability to transit influence of m'→n' of the grid at time "t−1" to influence of m→n at time "t" can be expressed by the following equation (8).

$$p_i(i_{min,t} \mid R_{1:t-1}) = \sum_{m'=1}^{Ng} \sum_{n'=1}^{Ng} p(g_t^{(i)} = m \mid g_{t-1}^{(i)} = m') \, p(g_t^{(i)} = n \mid g_{t-1}^{(i)} = n') \, p(i_{m'n',t-1} \mid R_{1:t-1}). \quad (8)$$

By using the equation (8), the prior probability of influence between grids can be obtained by the following equation (9).

$$p(i_{m,t} \mid R_{1:t-1}) = \prod_{n=1}^{Ng} p(i_{mn,t} \mid R_{1:t-1}). \quad (9)$$

As previously described, it is possible to estimate the prior probability of Interference between grids in time series. The above method can estimates (a prior probability) of influence between grids without any influence from the number of traffic participants. Further, the above method uses the transition potential (or the relative speed $v_{m,\,t-1}$) when influence is transited between grids. However, it is possible to use a simple Markov property in order to obtain the transition probability of influence between grids by using actual measured data items.

Figure 5:
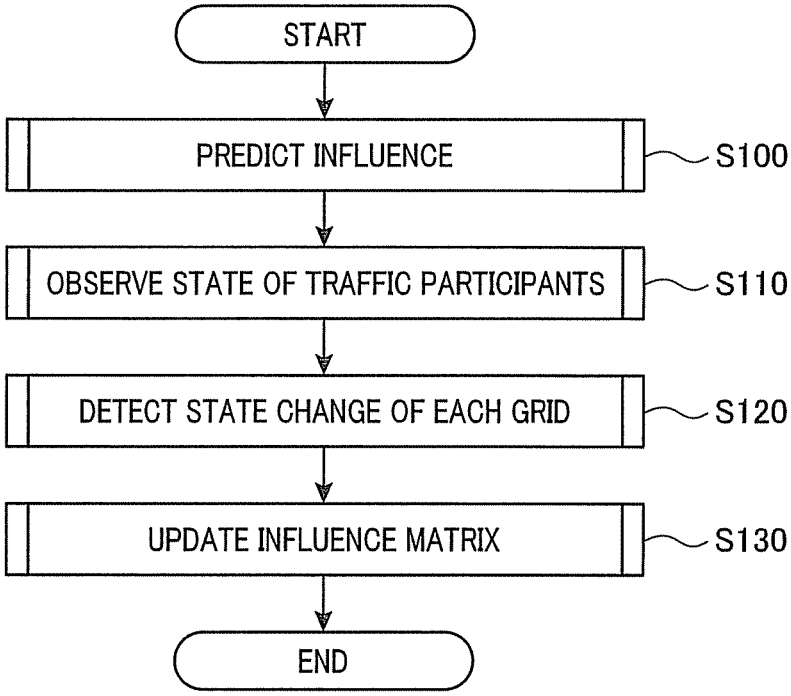
FIG. 5 is a flow chart showing a process of obtaining influence between grids as traffic participants.

FIG. 5 is a flow chart showing a process of obtaining influence between grids as traffic participants;

In step S100 shown in FIG. 5, a prior probability of influence of each grid is obtained in order to predict influence.

In step S110 shown in FIG. 5, the state of each traffic participant (grid) is observed. In step S120, the state change of each grid is detected on the basis of the observed state of each traffic participants (grid). This makes it possible to calculate the observation matrix R previously described.

Finally, in step S130 shown in FIG. 5, the posterior probability of influence estimated between the grids on the basis of the prior probability of influence and the observation matrix R of influence.

The example previously described calculates the observation matrix R by using the state change of grids on the basis of the presence and absence of influence from one grid to other grid and the assumption in which the presence and absence of influence from one grid to another grid is equal to the presence and absence of influence from another grid to one grid. However, it is not always said that the presence and absence of influence between the same grids is equal in different moving directions. For example, influence from one grid to another grid is not always equal to influence from another grid to one grid. Therefore it is possible to calculate the observation matrix R on the basis of the relation of cause and effect which is analyzed by using the change of grid state of another grid. The analysis of the relation of cause and effect is executed by using time information, for example, it is acceptable to use the prior state change of the grid as cause and to use the latter state change of the grid as effect. This makes it possible to independently estimate the posterior probability of influence between the same grids in different directions Next, a description will now be given of the process of predicting the transition of driving scene executed by the symbol transition prediction section 60 with reference to FIGS. 6A and 6B.

Figure 6A:
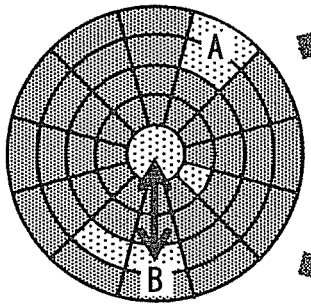
FIG. 6A, FIG. 6B and FIG. 6C are views showing the change of a future driving scene of an own motor vehicle which is changed according to influence between traffic participants (grids)
Figure 6B:
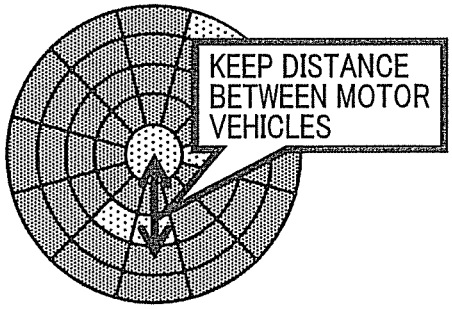
Figure 6C:
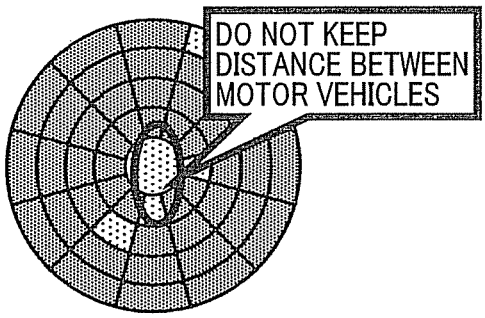

FIG. 6A, FIG. 6B and FIG. 6C are views showing the change of a future driving scene of the own motor vehicle which is changed according to influence between traffic participants as grids.

The driving scene shown in FIG. 6A will be considered. As shown in FIG. 6A, there are a preceding motor vehicle A which runs in front of the own motor vehicle and a following motor vehicle B which runs behind own motor vehicle. When the driver decelerates own motor vehicle, namely, reduces the speed of the own motor vehicle in order to increase a relative distance between the preceding motor vehicle A and the own motor vehicle, the driving scene of the own motor vehicle is largely changed by the condition whether or not there is a strong interaction (or a good interaction) between the own motor vehicle and the following motor vehicle (namely, whether or not there is influence between own motor vehicle and the following motor vehicle).

When there is influence (or adequately large influence), it can be considered for the following motor vehicle to gradually decelerate according to the deceleration of the own motor vehicle. In this case, there is a large probability to transit the driving scene as shown in FIG. 6B.

On the other hand, when there is no influence (or when the posterior probability of influence has a value which is not adequately large), there is a high probability to transit the current driving scene to another driving scene shown in FIG. 6C because the deceleration of the own motor vehicle supplies a limited influence to the following motor vehicle B.

As described above in detail, the driving scene of the own motor vehicle is largely changed according to whether influence between grids is considered or not. The prediction of the transition of a driving scene with influence can be executed by the following method, for example.

As previously described, the transition of influence between grids is considered (by using the equations (6) to (9)) when the prior probability of influence is calculated. The method of predicting the transition of grids with considering influence can be simply executed by modifying the equation (7).

A description will now be given of the method of predicting the transition of grids while considering influence.

In the transition model of influence between grids expressed by the equation (7), the moving potential of each grid is expressed by using a relative speed between grids, and the location of each grid applied by influence at a next time is predicted. This transition model is expressed by the following equation (10).

$$\hat{g}_{m,t}^{(p)} = g_{m,t-1}^{(p)} + \hat{V}_{m,t-1} \quad (10).$$

The hut "$v_{m,\,t-1}$" in the equation (10) is determined by using the following equation (11) in order to consider influence.

$$\hat{v}_{m,t-1} = \sum_{n=1}^{Ng} \{(1 - i_{mn,t-1})v_{m,t-1} + i_{mn,t-1} v_{n,t-1}\}. \quad (11)$$

Using the equation (11) makes it allow to switch the moving potential (hut "$v_{m,\ t-1}$") according to the presence or absence of influence. That is, when there is influence, the relative speed "$v_{m,\ t-1}$" is changed, and on the other hand, no relative speed is changed when there is no influence. Accordingly, it is possible to predict how each grid is transited.

However, because the relative speed $v_{m,\ t-1}$ in the equation (11) is completely replaced with another value, the prediction of transition of each grid is largely changed according to the presence or absence of influence. In order to avoid this, it is possible to slightly adjust the magnitude of transition of the predicted location of each grid according to the magnitude of the posterior probability of influence. In order to obtain the above fine adjustment, it is sufficient to calculate the moving potential (relative speed hut "$v_{m,\ t-1}$") by using the following equation (12)

$$\hat{v}_{m,t-1} = \sum_{n=1}^{Ng} \{(1 - p(i_{mn,t-1} \mid R_{1:t-1}))v_{m,t-1} + p(i_{mn,i-1} \mid R_{1:t-1})v_{n,t-1}\}. \quad (12)$$

The equation (12) uses the posterior probability of influence as a weighting value to two speeds. Accordingly, this makes it possible to calculate the relative speed $v_{m,\ t-1}$ according to the magnitude of posterior probability of influence by using the equation (12).

The above method predicts the driving scene of the own motor vehicle while considering influence. By the way, the future driving scene is largely changed depending on the operation of the own motor vehicle. Accordingly, a plurality of operations is predicted as candidate of a future operation of the own motor vehicle, and the transition result of the driving scene when each predicted operation is selected is predicted. Further, a process of predicting the transition result of the driving scene is repeatedly executed when a plurality of operations, as candidates of operation of the own motor vehicle as the predicted driving scene occur. This process makes it possible to predict the transition of the driving scene in each operation in the time series. That is, it is possible to predict the transition of the driving scene for a relatively long time period with high accuracy.

Figure 7:
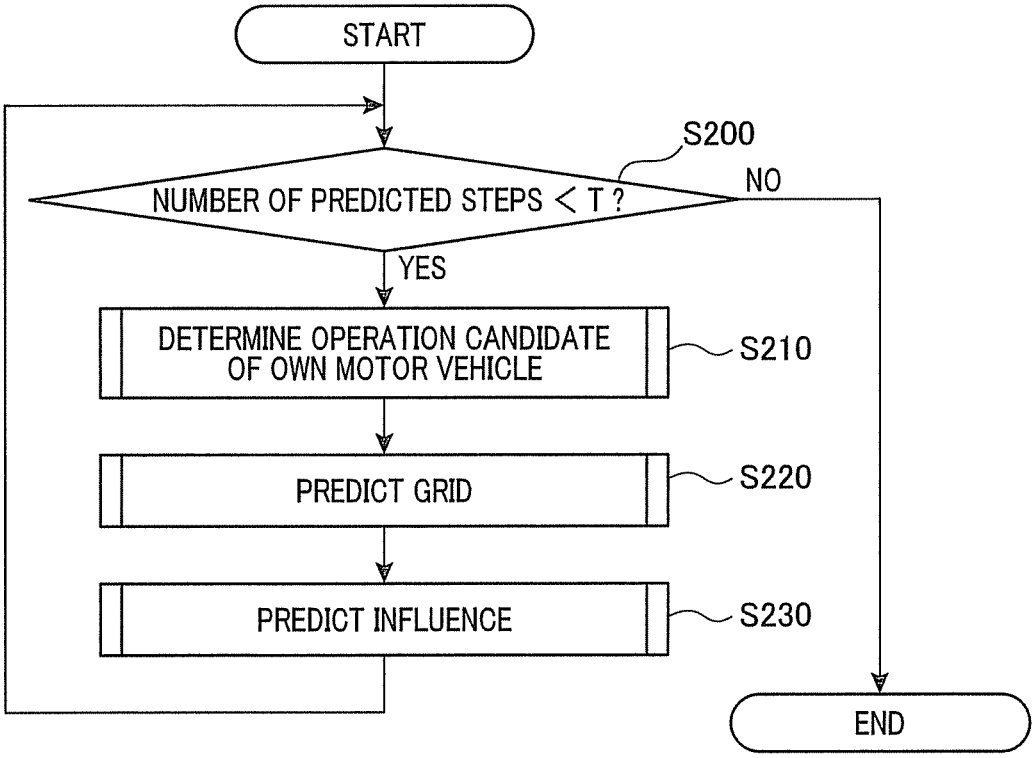
FIG. 7 is a flow chart showing a process of predicting the transition of a future driving scene executed by a symbol transition prediction section in the recommended driving operation display device according to the exemplary embodiment shown in FIG. 1.

FIG. 7 is a flow chart showing a process of predicting the transition of the driving scene executed by the symbol transition prediction section 60 in the recommended driving operation display drive according to the exemplary embodiment shown in FIG. 1.

In step S200 shown in FIG. 7, it is detected whether or not the repeated number of executing a prediction step by the symbol transition prediction section 60 exceeds a predetermined number T.

When the detection result indicates that the number of repeated execution of the step is not more than the predetermined number T, the operation flow goes to step S210. In step S210, the prediction process is continuously executed.

On the other hand, when the detection result indicates that the repeated number of executing the prediction step reaches the predetermined number T, the process shown in FIG. 7 is completed.

In step S210, although it is possible to randomly generate the plurality of candidates of operations of the own motor vehicle on the basis of operation of the own motor vehicle at each time, it is preferable to select the operation of the own motor vehicle with a high priority on the basis of the information obtained by the drive environmental information obtaining section 10, the traffic participant information obtaining section 20 and the own motor vehicle information obtaining section 30.

The more the number of operation candidates selectable by the own motor vehicle is increased, the more the prediction accuracy of the future driving scene is increased. However, this needs a long period of time of executing the prediction process according to increasing the number of such candidates of operation. On the other hand, it is possible to obtain a future operation selectable by the own motor vehicle with a high priority by considering the information of the drive environment or lane environment of the own motor vehicle drives, the information regarding the traffic participants such as other motor vehicles, pedestrians and traffic signals, and the information regarding the own motor vehicle. Accordingly, it is possible to predict the future driving scene of the own motor vehicle with high accuracy even if the number of operation candidates selectable by the own motor vehicle is increased.

For example, when visibility around the own motor vehicle is gradually decreased by a dark weather, there is a high possibility for the driver of the own motor vehicle to expand the vehicle distance between the own motor vehicle and a preceding motor vehicle which drives in front of the own motor vehicle on the same lane. Further, the driver of the own motor vehicle has already set a destination to the navigation device mounted to the own motor vehicle, there is a high possibility for the driver of the own motor vehicle to select the drive lanes which have been set to the navigation device, right-turn and left-turn which are determined along the route which has already been set to the navigation device. This case makes it possible to easily predict the future operation of the own motor vehicle on the basis of the information regarding the change of the drive lanes, the right-turn and left-turn.

Still further, because the driver of the own motor vehicle has generally driving habit, the driving habit is stored in advance as an operation model of the driver of the own motor vehicle. It is possible to predict the future operation selectable by the own motor vehicle on the basis of the stored operation model of the driver of the own motor vehicle.

The operation of time series generated after $\tau$ steps counted from time "t" in the operation of time series comprised of a plurality of operations executed in series of time is expressed as vector by the following equation (13).

$$d_{t+\tau|t}^{(n)} = (d_1, \ldots, d_\tau)^T, n=1, \ldots, Ns \quad (13).$$

The driving scene is predicted according to each operation of time series generated. That is, in step S220, the grid transition is predicted (by using the equations (10) to (12), and the prediction of influence is executed in step S230 by using the equations (6) to (9)). The moving potential of the own motor vehicle is correctly set according to the operation candidate at each time. By the way, in the prediction of influence, the posterior probability is not updated by using the observation matrix R.

Figure 8:
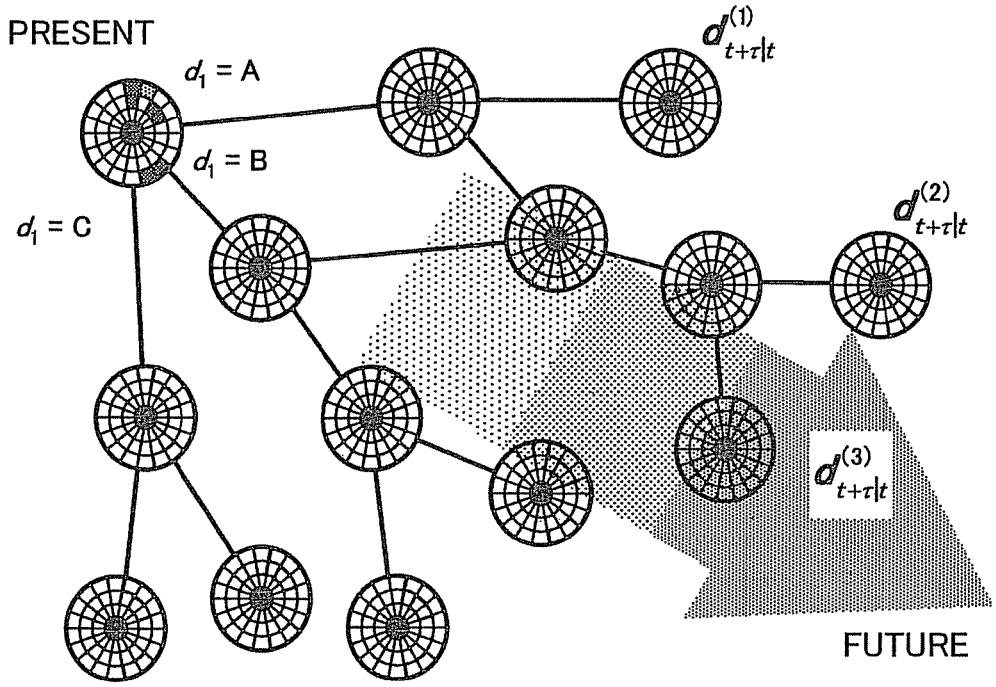
FIG. 8 is a view showing a plurality of predicted driving scenes which are predicted on the basis of a time series of a plurality of operations which is performed in a time series.

FIG. 8 is a view showing a plurality of predicted driving scenes which are predicted on the basis of time series of a plurality of operations which is performed in time series.

The predicted Ns driving scenes are generated as shown in FIG. 8 by repeatedly executing the series of steps S210 to S230 until the number of the prediction steps reaches the predetermined number T. The exemplary embodiment shown in FIG. 8 uses the three candidates A, B and C of operation of the own motor vehicle. After this, when the prediction of grids and the prediction of influence are executed on the basis of the operations A, B and C, the prediction step progresses by one step. In the predicted driving scene (as the result of transition of the driving scene), the operation candidate is further selected, and the transition of the driving scene is predicted on the basis of the predicted operation candidate. After $\tau$ steps, the execution of these prediction processes makes it possible to obtain a plurality of Ns sets composed of operation vectors and driving scenes in time series as the results of the execution of each step arranged in each dimension.

The obtained vectors and the driving scenes of the operation in time series are provided to a recommended operation generation section 70. When receiving these vectors and the predicted driving scenes, the recommended operation generation display section 70 classifies and evaluates the received vectors and the driving senses in time series, and finally evaluates an operation (in time series) to transit to the positive driving scene and an operation (in time series) to transit to a negative driving scene.

Figure 9:
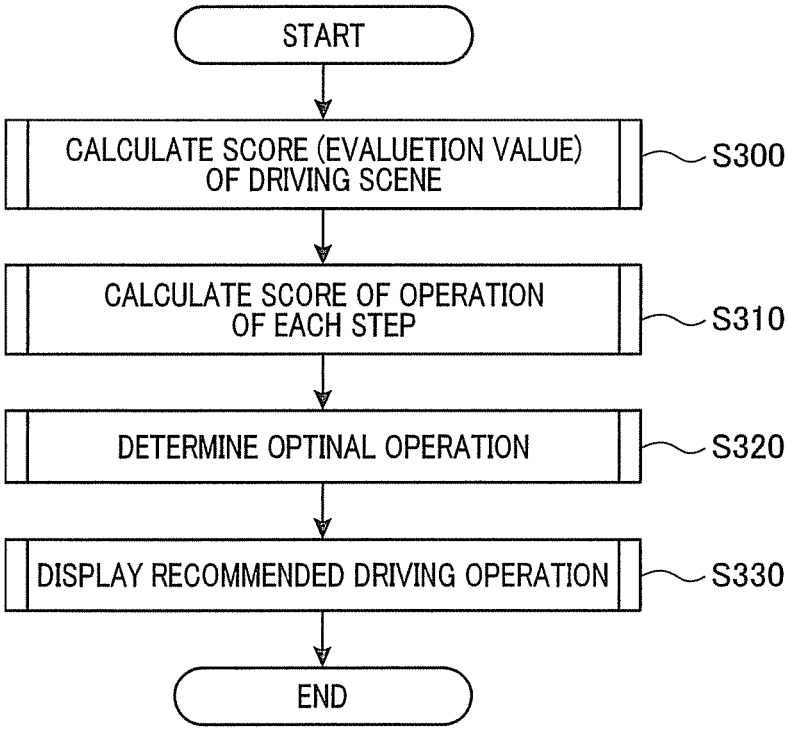
FIG. 9 is a flow chart showing a process executed by a recommended operation generation display section in the recommended driving operation display device according to the exemplary embodiment shown in FIG. 1.

FIG. 9 is a flow chart showing a process executed by the recommended operation generation display section 70 in the recommended driving operation display device according to the exemplary embodiment shown in FIG. 1.

In step S300 shown in FIG. 9, the recommended operation generation display section 70 calculates a score (as an evaluation value) of each of the predicted driving scenes supplied from the symbol transition prediction section 60.

The recommended operation generation display section 70 sets in advance typical driving scenes and evaluation values. The typical driving scenes correspond to the driving scenes in one-to-one correspondence. For example, there are typical driving scenes such as a driving scene of a traffic congestion, a driving scene of a traffic accident, a driving scene of a smoothly traffic flow in which motor vehicles smoothly flow, a driving scene in which a motor vehicle switches a drive lane, and a driving scene of an optimal turn-right.

A positive evaluation value is assigned to an optimal driving scene. On the other hand, a genitive evaluation scene is assigned to a driving scene to be avoided.

The recommended operation generation display section 70 calculates a score of the predicted driving scene on the basis of the predicted driving scene and a typical driving scene. For example, when the predicted driving scene is described by using grids and information of influence, the score of the predicted driving scene can be expressed by the following equation (14).

$$s_{t+\tau|t}^{(n)} = \sum_{m=1}^{No} \alpha_m D(S_{t+\tau|t}^{(n)} \,||\, S_m^*). \tag{14}$$

In the equation (14), "sm*; m=1, . . . , Nc" corresponds to a typical driving scene which is set in advance, and "D $(S_1||S_2)$" is a function to detect a degree of similarity between driving scenes, and $\alpha_m$ is an evaluation value of the typical driving scene. The degree of similarity between driving scenes can be calculated by adding, as a weight, a distance between vectors of influence and grids.

In step S310, the recommended operation generation display section 70 calculates the score of operation of each step in operation time series by using the score of the driving scene calculated in step S300. The recommended operation generation display section 70 calculates the score in operation of each step by using an average value of the scores of the driving scenes which are finally transited after the operation, as expressed by the following equation (15).

$$s_d(d_\tau = d) = \frac{1}{Nd} \sum_{n:d_\tau^{(n)}=d} s_{t+\tau|t}^{(n)}. \tag{15}$$

In step S320, the recommended operation generation display section 70 selects as the optimal operation the operation with the highest score contained in the operation time series during the same time period. Further, in step S330, the recommended operation generation display section 70 provides the recommended driving operation to the driver of the own motor vehicle by using images and voice according to the optimum operation determined in step S320. This makes it possible to show the recommended driving operation to the driver of the own motor vehicle by images and voice.

It is also possible to select the optimal driving scene from the predicted driving scenes only on the basis of the scores of the predicted driving scenes to which the own motor vehicle is finally transited, and to determine the operation to be transited to the optimal driving scene as the most preferable operation. However, when the driver of the own motor vehicle selects an operation, which is different from the recommended driving operation, on the way to reach the most preferable driving scene, for example when there is a possibility of being transited to the driving scene having a negative score, it is not always said that the driving operation to reach the most preferable driving scene is correctly fitted to the recommended driving operation. As previously described, the recommended operation generation display section 70 uses the average value of the scores of the driving scenes to be transited on selecting each operation when the operation to determine the recommended driving operation is selected. Accordingly, this makes it possible to avoid the driving operation, which introduces the driving scene to be always avoided, from being recommended to the driver of the own motor vehicle.

A description will now be given of some examples of operation by the recommended driving operation display device equipped with the driving scene transition prediction device according to the exemplary embodiment.

First operation example is an operation to change or switch a current drive lane. In the first operation example, the drive environmental information obtaining section 10 obtains environmental information such as at least a lane mark, a distance to a next intersection and a state of a traffic signal. The traffic participant information obtaining section 20 obtains at least a location, a speed and a state of directional indicators of motor vehicles around the own motor vehicle. The own motor vehicle information obtaining section 30 obtains at least a location, a speed, a steering angle and a state of directional indicators of the own motor vehicle.

The symbolizing execution section 40 maps, on a grid space around the own motor vehicle, each information obtained by the drive environmental information obtaining section 10, the traffic participant information obtaining section 20 and the own motor vehicle information obtaining section 30. The symbolizing execution section 40 symbolizes the mapped information as vectors, and transfers the symbolized vectors to the interaction estimation section 50 and the symbol transition prediction section 60.

The interaction estimation section 50 estimates whether or not the interaction occurs between the traffic participants mapped on the grid space. The estimated interaction between the traffic participants is transferred to the symbol transition prediction section 60 as the influence matrix I in which the symbols of driving scenes and the estimated interaction are related to each other.

The symbol transition prediction section 60 predicts the transition of the driving scene by using the symbols of the driving scenes and the influence matrix I. That is, the symbol transition prediction section 60 assumes the presence and absence of changing the drive lane of the own motor vehicle, and calculates a probability to transit the driving scene to another driving scene. In this case, it is possible to calculate the effect to change the drive lane of the own motor vehicle on the basis of the probability of the driving scene to enter traffic congestion and traffic accident. It is further possible to directly estimate the operation to cause the driving scene suitable to change the drive lane. The recommended operation generation section 70 provides the effects obtained by the symbol transition prediction section 60 to the driver of the own motor vehicle through the display and acoustic sound in order to request the driver of the own motor vehicle to change the current drive lane.

Further, the recommended operation generation section 70 informs, through display and acoustic sound to the driver of the own motor vehicle, the information whether or not another motor vehicle reacts against the signal of the directional indicators of the own motor vehicle estimated by the interaction estimation section 50. This makes it possible to lead the driver of the own motor vehicle to smoothly join with other motor vehicles at a highway.

The second operation example regards the operation to suppress traffic congestion from being generated or occurred. In the second operation example, the drive environmental information obtaining section 10 obtains the environmental information such as at least a shape of a road, a slope of the road. The traffic participant information obtaining section 20 obtains at least the location and speed of motor vehicles around the own motor vehicle. The own motor vehicle information obtaining section 30 obtains at least the location and speed of the own motor vehicle.

When the change of the transition of the driving scene is predicted, the symbol transition prediction section 60 assumes the presence and absence of acceleration, deceleration and change of the drive lane of the own motor vehicle, and calculates whether or not the transition of the driving scene to another driving scene has a high probability. This makes it possible to predict the effects of the operation of the own motor vehicle on the basis of the generation probability to enter traffic congestion. The recommended operation generation section 70 provides the effects obtained by the symbol transition prediction section 60 to the driver of the own motor vehicle through the display and sound. The driver of the own motor vehicle selects the optimal driving operation of the own motor vehicle on the basis of the effects supplied from the symbol transition prediction section 60.

The third operation example regards the operation to provide a recommended driving operation to the driver of the own motor vehicle in order to avoid the own motor vehicle from being in contact with another motor vehicle which comes on the opposite drive lane when the own motor vehicle turns right at an intersection, or to avoid own motor vehicle from being in contact with another motor vehicle which turns right from the opposite drive lane when the own motor vehicle goes straight on the current drive lane.

In the third exemplary example, the drive environmental information obtaining section 10 obtains the environmental information such as at least a shape of an intersection and a ratio of dead angle. The traffic participant information obtaining section 20 obtains at least the location of other motor vehicles around the own motor vehicle, the state of directional indicators of the other motor vehicles and the state of traffic signals. Further, the own motor vehicle information obtaining section 30 obtains at least the location of the own motor vehicle, the speed of the own motor vehicle, and the state of directional indicators of the own motor vehicle.

On predicting that own motor vehicle is transited to what driving scene as a result, the symbol transition prediction section 60 calculates a probability to transit a symbol of a driving scene to another driving scene on assuming the presence and absence of acceleration and deceleration of the own motor vehicle and assuming the presence of stopping the own motor vehicle. This makes it possible to calculate the effects of operation of the own motor vehicle by using the probability of occurrence of a traffic accident to be caused. On the basis of the effects obtained by the symbol transition prediction section 60, the recommended operation generation section 70 requests the driver of the own motor vehicle to have an operation of avoiding a traffic accident through the display and sound in order to request the driver of the own motor vehicle to change the current drive lane.

Because lacking of information regarding influence introduces many accidents when the own motor vehicle is turns right, it is effective to provide the results obtained by the interaction estimation section 50 directly to the driver of the own motor vehicle.

As previously described in detail, the symbol transition prediction section 60 in the recommended driving operation display device equipped with the driving scene transition prediction device according to the exemplary embodiment of the present invention predicts how the driving scene described by using various symbols is transited to another driving scene in the candidates of operation of the own motor vehicle. At this time, the symbol transition prediction section 60 predicts how the symbolized driving scene is transited by using influence of the own motor vehicle to traffic participants estimated on the basis of the state of change of each of the traffic participants containing own motor vehicle and other motor vehicles. Accordingly, on predicting the transition of the driving scene, it is possible to decrease the total amount of calculation. Further, because influence is estimated on the basis of actual state change of each of the traffic participants, it is possible to increase the accuracy of predicting the transition of the driving scene.

(Other Features and Effects of the Exemplary Embodiments of the Present Invention)

In the driving scene transition prediction device in the recommended driving operation display device according to the exemplary embodiment, the symbolizing execution section 40 determines a virtual grid, assigns the virtual grid to a grid at a location of the traffic participant detected by the traffic participant information obtaining section 20 and expresses the location of each of the traffic participants. The symbolizing execution section 40 symbolizes the driving scene by using a symbol vector composed of predetermined information to be symbolized regarding drive environment or lane environment, own motor vehicle and the traffic participants. This makes it possible to easily symbolize the desired information regarding own motor vehicle and the traffic participants.

Further, in the driving scene transition prediction device in the recommended driving operation display device, it is preferable that the prediction section 60 determines a plurality of types of operation candidates selectable by the own motor vehicle, and predicts a result of transition of the driving scene when each determined operation is executed. The prediction section 60 repeatedly executes the process of predicting a transition result of the driving scene when plural types of the operation candidates selectable by the own motor vehicle are executed. The prediction section 60 predicts the transition state of the driving scene in each of time series of the operations executed in time series.

When the own motor vehicle selects a different operation in future which is different from the predicted operation, a future driving scene around the own motor vehicle is largely changed. It is therefore possible to predict the driving scene of the own motor vehicle with high accuracy for a long period of time by repeatedly executing the process of predicting the transition result of the driving scene when own motor vehicle has different types of operations within the transition results of the predicted driving scenes.

In the driving scene transition prediction device in the recommended driving operation display device according to the exemplary embodiment, it is preferable that the prediction section 60 determines the operation candidate selectable by the own motor vehicle on the basis of the information obtained by the drive environmental information obtaining section 10. The more the number of the operation candidates selectable by the own motor vehicle is increased, the more the accuracy of predicting the future driving scene of the own motor vehicle is increased. On the other hand, this needs a long period of time to calculate the future driving scene according to increasing the number of the operation candidates. However, it is possible to select the operations having high possibility selectable by the own motor vehicle by using the information of the drive environment or lane environment. Accordingly, it is possible to predict the driving scene with high accuracy without increasing the number of the operation candidates selectable by the own motor vehicle.

The driving scene transition prediction device in the recommended driving operation display device according to the exemplary embodiment further has an own motor vehicle information obtaining section 30 for obtaining information regarding the driver of the own motor vehicle. In the driving scene transition prediction device, the prediction section 60 determines the operation candidate selectable by the own motor vehicle on the basis of the information regarding the driver of the own motor vehicle obtained by the own motor vehicle information obtaining section 30.

In general, because each of the driver of the own motor vehicle and the drivers of other motor vehicles as the traffic participants has driving habit, it is possible for the prediction section 60 to predict the operation candidates having high accuracy selectable by the driver of the own motor vehicle on the basis of the information regarding the driving habit of the driver.

In the driving scene transition prediction device in the recommended driving operation display device according to the exemplary embodiment, it is preferable that the own motor vehicle information obtaining section 30 has a section for obtaining information regarding drive operation selectable by the driver of the own motor vehicle. The prediction section 60 determines, as the operation candidate selectable by the driver of the own motor vehicle, the operation selectable by the own motor vehicle in order to execute the drive of the own motor vehicle desired by the driver of the motor vehicle. For example, when the driver of the own motor vehicle wants to change the current drive lane to another drive lane, or to turn right, it is possible for the device to narrow the optimum operations which can be selected by the own motor vehicle.

The recommended driving operation display device equipped with the driving scene transition prediction device for a motor vehicle according to exemplary embodiment has the driving scene transition prediction device and the recommended driving operation display section 70. The driving scene transition prediction device is previously described in detail. The recommended driving operation display section 70 determines a recommended driving operation on the basis of the prediction results obtained by the prediction section 60 in the driving scene transition prediction device. The recommended driving operation display section 70 displays the recommended driving operation to the driver of the own motor vehicle. This structure of the recommended driving operation display device makes it possible to display the preferable driving operation to the driver of the own motor vehicle on the basis of the predicted transition results of the driving scene having a high accuracy.

In the recommended driving operation display device according to the exemplary embodiment, it is preferable that the recommended driving operation display section generates in advance a plurality of typical driving scenes and an evaluation value of each of the typical driving scenes. The recommended driving operation display section calculates an evaluation value of a transition result of the predicted driving scene on the basis of a degree of similarity between the transition result of the predicted driving scene and the typical driving scenes. The recommended driving operation display section determines the recommended driving operation on the basis of the calculated evaluation result of the transition result of the predicted driving scene.

For example, it is possible for the device to use, as typical driving scenes, a driving scene of a traffic congestion, a driving scene of a traffic accident, a driving scene of smoothly flowing traffic in which motor vehicles smoothly flow, a driving scene in which a motor vehicle switches a drive lane and a driving scene of an optimal turn-right. That is, the device assigns a positive evaluation value to the positive driving scene, and assigns a negative evaluation value to the negative driving scene. This makes it possible to calculate the evaluation value on the basis of the similarity between the predicted transition result of the driving scene and the typical driving scenes.

In the recommended driving operation display device equipped with the driving scene transition prediction device according to the exemplary embodiment, it is preferable that the prediction section 60 repeatedly executes a series of the following processes: a process of determining a plurality of operations as operation candidates of the own motor vehicle selectable by the driver of the own motor vehicle; a process of predicting a transition result of the driving scene when each of the determined operations as the operation candidates is executed; and a process of predicting a transition result of the driving scene when a plurality of operations selectable by the own motor vehicle is executed within the transition result of the predicted driving scene. In the recommended driving operation display device, when the prediction section 60 predicts the transition of the driving scene in each of the above series, the recommended driving operation display section 70 calculates an evaluation value of the predicted driving scene to which the current driving scene is finally transited, calculates a mean value of the evaluation values of the predicted driving scenes after the execution of the operations of the series, and determines the recommended driving operation according to the operations having the maximum mean value.

It is also possible for the device to simply select the optimal driving scene depending on the evaluation value of the predicted driving scene to which the current driving scene is finally transited. However, when the driver of the own motor vehicle selects another driving operation, which is different from the recommended driving operation, and when there is a possibility to be shifted to a driving scene with a low evaluation result, it is always said that the driving operation is the most suitable driving scene to reach the optimal driving scene. At this point, the recommended driving operation display device equipped with the driving scene transition prediction device according to the exemplary embodiment uses the mean value of the driving scenes to which the driving scene is transited when each operation is selected when the operation is selected in order to determine the recommended driving operation. This makes it possible to avoid the driving operation from being selected, which introduces a driving scene which is usually eliminated by the driver of the own motor vehicle.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A driving scene transition prediction device comprising:

means for obtaining information regarding lane environment of a lane on which an own motor vehicle drives;

means for detecting traffic participants around the own motor vehicle;

means for symbolizing information regarding a drive environment or a lane environment, information regarding own motor vehicle and information regarding the traffic participants which form a driving scene of the own motor vehicle, and for describing the driving scene of the own motor vehicle by using the symbolized information;

means for estimating interaction, as influence, between the traffic participants on the basis of a state change of each of the traffic participants including the own motor vehicle;

means for predicting a transition of the symbolized driving scene symbolized by the symbolizing means for each of a plurality of candidates selectable by the own motor vehicle on the basis of the influence estimated by the estimating means; wherein a recommended driving operation display device; and means for determining a recommended driving operation on the basis of the prediction results obtained by the predicting means in the driving scene transition prediction device, and for displaying the recommended driving operation to a driver of the own motor vehicle on the recommended driving operation device; wherein the determining means generates a plurality of typical driving scenes and an evaluation value of each of the typical driving scenes, calculates an evaluation value of a transition result of a predicted driving scene on the basis of a degree of similarity between the transition result of the predicted driving scene and the typical driving scenes, and determines the recommended driving operation on the basis of the calculated evaluation result of the transition result of the predicted driving scene; and the predicting means repeatedly executes a series of steps including:

determining a plurality of operations as operation candidates of the own motor vehicle selectable by the driver of the own motor vehicle;

predicting a transition result of the driving scene when each of the determined operations as the operation candidates is executed; and predicting a transition result of the driving scene when a plurality of operations selectable by the own motor vehicle is executed within the transition result of the predicted driving scene, wherein when the predicting means predicts the transition of the driving scene in each of the above series, the determining means calculates an evaluation value of the predicted driving scene finally obtained, calculates a mean value of the evaluation values of the predicted driving scenes after the execution of the operations of the series, and determines the recommended driving operation according to the operations having the maximum mean value.

2. The driving scene transition prediction device according to claim 1, wherein the symbolizing means determines a virtual grid, assigns the virtual grid to a grid at a location of each of the traffic participants detected by the detecting means, expresses the location of each of the traffic participants, and symbolizes the driving scene by using a symbol vector composed of predetermined information to be symbolized regarding drive environment or lane environment, the own motor vehicle and the traffic participants.

3. The driving scene transition prediction device according to claim 1, wherein the predicting means determines a plurality of types of operation candidates selectable by the own motor vehicle, and predicts a result of transition of the driving scene when each determined operation is executed, the predicting means repeatedly executes the process of predicting a transition result of the driving scene when the plurality of types of the operation candidates selectable by the own motor vehicle is executed, and the predicting means predicts a transition state of the transition of the driving scene of each of the operation candidates.

4. The driving scene transition prediction device according to claim 1, wherein the predicting means determines an operation candidate selectable by the own motor vehicle on the basis of the information obtained by the obtaining means.

5. The driving scene transition prediction device according to claim 1, further comprising means for obtaining information regarding the driver of the own motor vehicle, wherein the predicting means determines an operation candidate selectable by the own motor vehicle on the basis of the information regarding the driver of the own motor vehicle obtained by the means for obtaining information regarding the driver.

6. The driving scene transition prediction device according to claim 5, wherein the means for obtaining information regarding the driver comprises means for obtaining information regarding driving operation intended by the driver of the own motor vehicle, the predicting means determines, as the operation candidate selectable by the driver of the own motor vehicle, the operation selectable by the own motor vehicle in order to execute the drive of the own motor vehicle desired by the driver of the motor vehicle.

7. A driving scene transition prediction device comprising:

means for obtaining information regarding lane environment of a lane on which an own motor vehicle drives;

means for detecting traffic participants around the own motor vehicle;

means for symbolizing information regarding a drive environment or a lane environment, information regarding own motor vehicle and information regarding the traffic participants which form a driving scene of the own motor vehicle, and for describing the driving scene of the own motor vehicle by using the symbolized information;

means for estimating interaction, as influence, between the traffic participants on the basis of a state change of each of the traffic participants including the own motor vehicle;

means for predicting a transition of the symbolized driving scene symbolized by the symbolizing means for each of a plurality of candidates selectable by the own motor vehicle on the basis of the influence estimated by the estimating means;

the symbolizing means determines a virtual grid, assigns the virtual grid to a grid at a location of each of the traffic participants detected by the detecting means, expresses the location of each of the traffic participants, and symbolizes the driving scene by using a symbol vector composed of predetermined information to be symbolized regarding drive environment or lane environment, the own motor vehicle and the traffic participants;

the predicting means determines a plurality of type of operation candidates selectable by the own motor vehicle, and predicts a result of transition of the driving scene when each determined operation is executed, the predicting means repeatedly executes the process of predicting a transition result of the driving scene when the plurality of types of the operation candidates selectable by the own motor vehicle is executed, and the predicting means predicts a transition state of the transition of the driving scene of each of the operation candidates;

a recommended driving operation display device; and means for determining a recommended driving operation on the basis of the prediction results obtained by the predicting means in the driving scene transition prediction device, and for displaying the recommended driving operation to the driver of the own motor vehicle on the recommended driving operation device; wherein the determining means generates a plurality of typical driving scenes and an evaluation value of each of the typical driving scenes, calculates an evaluation value of a transition result of a predicted driving scene on the basis of a degree of similarity between the transition result of the predicted driving scene and the typical driving scenes, and determines the recommended driving operation on the basis of the calculated evaluation result of the transition result of the predicted driving scene; and the predicting means repeatedly executes a series of steps including:

determining a plurality of operations as operation candidates of the own motor vehicle selectable by the driver of the own motor vehicle;

predicting a transition result of the driving scene when each of the determined operations as the operation candidates is executed; and predicting a transition result of the driving scene when a plurality of operations selectable by the own motor vehicle is executed within the transition result of the predicted driving scene, wherein when the predicting means predicts the transition of the driving scene in each of the above series, the determining means calculates an evaluation value of the predicted driving scene finally obtained, calculates a mean value of the evaluation values of the predicted driving scenes after the execution of the operations of the series, and determines the recommended driving operation according to the operations having the maximum mean value.

8. The driving scene transition prediction device according to claim 7, wherein the predicting means determines an operation candidate selectable by the own motor vehicle on the basis of the information obtained by the obtaining means.

9. The driving scene transition prediction device according to claim 7, further comprising means for obtaining information regarding a driver of the own motor vehicle, wherein the predicting means determines an operation candidate selectable by the own motor vehicle on the basis of the information regarding the driver of the own motor vehicle obtained by the means for obtaining information regarding the driver.

10. The driving scene transition prediction device according to claim 9, wherein the means for obtaining information regarding the driver comprises means for obtaining information regarding driving operation intended by the driver of the own motor vehicle, the predicting means determines, as the operation candidate selectable by the driver of the own motor vehicle, the operation selectable by the own motor vehicle in order to execute the drive of the own motor vehicle desired by the driver of the motor vehicle.

* * * * *